United States Patent [19]

Gaston et al.

[11] 4,373,299

[45] Feb. 15, 1983

[54] TOOL FINISHING MACHINE HAVING IMPROVED SUPPORT TABLE

[75] Inventors: Harold W. Gaston; Donald J. Glaser, both of Emporia, Kans.

[73] Assignee: Glendo Corporation, Emporia, Kans.

[21] Appl. No.: 234,424

[22] Filed: Feb. 13, 1981

[51] Int. Cl.[3] ..... B24B 7/02

[52] U.S. Cl. ..... 51/122; 51/232

[58] Field of Search ..... 51/122, 125, 109, 219 R, 51/232; 125/14

[56] References Cited

U.S. PATENT DOCUMENTS

| | | | |
|---|---|---|---|
| 238,366 | 3/1881 | Doane . | |
| 427,477 | 5/1890 | Lawles . | |
| 910,350 | 1/1909 | Bastian | 51/122 |
| 970,351 | 9/1910 | Pike et al. . | |
| 2,176,726 | 10/1939 | Shepherd . | |
| 2,425,982 | 8/1947 | Bazley | 51/122 |
| 2,565,309 | 8/1951 | Jacoby, Jr. . | |
| 2,589,489 | 3/1952 | Fuhr . | |
| 2,724,931 | 11/1955 | Brandt | 51/219 R |
| 2,974,451 | 3/1961 | Bader et al. . | |
| 3,020,681 | 2/1962 | Hite | 51/122 |
| 3,054,229 | 9/1962 | Peasley et al. . | |
| 3,323,507 | 6/1967 | Schuman | 125/14 |
| 3,566,550 | 3/1971 | Piccinino . | |
| 3,928,946 | 12/1975 | Wynn | 51/109 R |

FOREIGN PATENT DOCUMENTS 2252549 5/1974 Fed. Rep. of Germany .

OTHER PUBLICATIONS

Brochure entitled "New von SRD FINISHER 2000 . . . schleift feinste Werkzeugoberflachen".

Brochure entitled "Accu-Finish", distributed by Glendo Corporation.

*Primary Examiner*—Harold D. Whitehead

*Attorney, Agent, or Firm*—Schmidt, Johnson, Hovey & Williams

[57] ABSTRACT

A tool sharpening or finishing machine is provided having an improved, low cost, laterally shiftable and tiltable tool-supporting table adjacent a rotatable, abrasive wheel. The table is supported for back-and-forth shifting by a roller bearing assembly having a plurality of spaced apart and resiliently biased together bearings connected to a base, with a shiftable element received between the bearings and connected to the table. The base is preferably slotted between the spaced bearings to form a structural spring within the base, and one of the bearings is eccentrically mounted for selective variation of the effective distance between the bearings, so that the bearing assembly can be properly preloaded without the need for precision manufacture of the assembly components. The table is supported for tilting movement relative to the grinding wheel surface by means of an upright, pivotal plate which has an associated spring-loaded counterbalancing mechanism urging the table upwardly and permitting accurate table settings.

8 Claims, 9 Drawing Figures

Fig. 5.
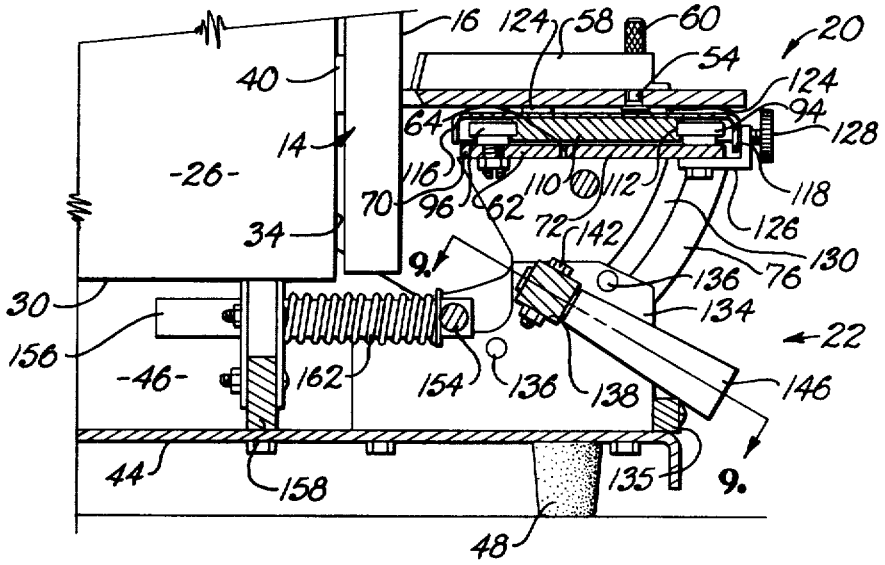
Fig. 6.
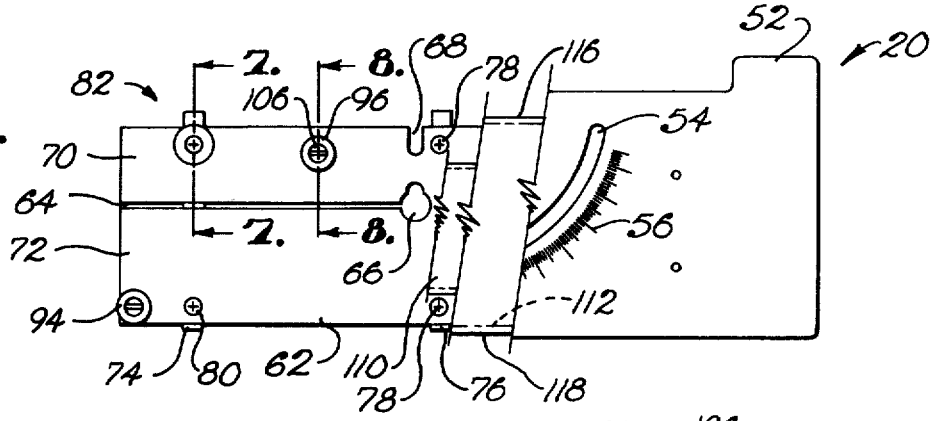
Fig. 7.
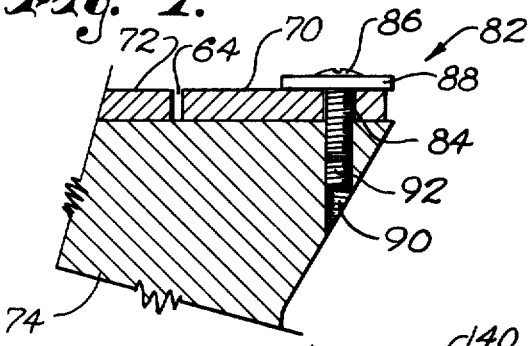
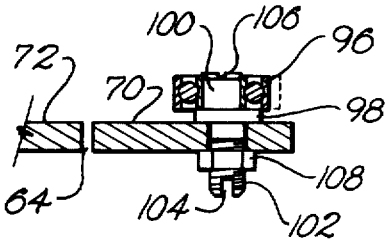
Fig. 8.
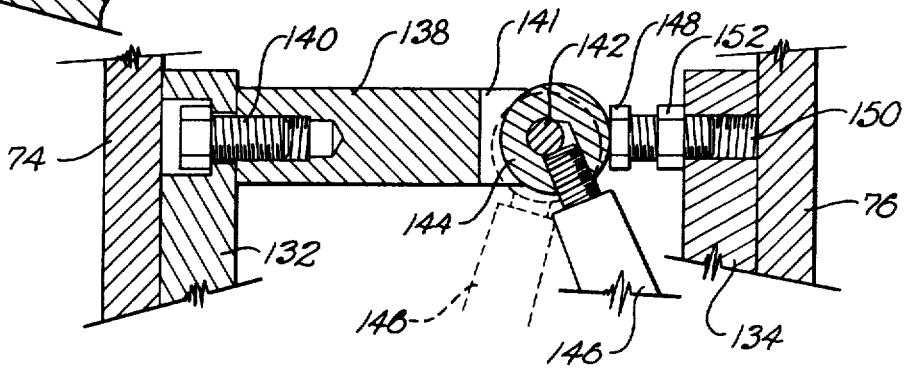
Fig. 9.

TOOL FINISHING MACHINE HAVING IMPROVED SUPPORT TABLE

BACKGROUND OF THE INVENTION

1. Field of the Invention

The present invention is concerned with an improved tool sharpening or finishing machine especially adapted for accurate operations in connection with a wide variety of cutting and boring tools. More particularly, it is concerned with such a machine having a greatly improved, yet low cost tool-supporting table which is mounted for back-and-forth shifting relative to a grinding wheel through the medium of a unique roller bearing assembly. In addition, the table is tiltable relative to the grinding wheel surface, and is provided with a spring loaded counterbalancing mechanism permitting rapid and accurate tilt adjustment of the table.

2. Description of the Prior Art

Many cutting tools used in lathes, machine shop equipment, and in other contexts require relatively frequent replacement or resharpening, in order to maintain the accuracy of the tools. In the past, it has been common practice to simply replace worn tools of the replaceable insert type, inasmuch as replacement was more economical then resharpening certain cutting tool inserts. However, the cost of tool inserts has risen dramatically in recent years to the point where it is now economically feasible to resharpen these tools and easily possible to do so with this improved tool sharpening machine.

Free hand tool sharpening is, generally speaking, a relatively quick operation. However, in most instances the free hand method can only rough shape a cutting tool. Freehand sharpening to accurate angles and fine surface finishes demands considerable time and skill, and is therefore expensive. Accordingly, there is a real need for a simplified, relatively inexpensive device which can be used to sharpen tools to accurate angles and good finishes.

In addition, tool sharpening machines are also illustrated in the following patents: U.S. Pat. Nos. 238,366; 427,477; 970,351; 2,176,726; 2,565,309; 2,589,489; 2,974,451; 3,054,229; 3,566,550 and German Pat. No. 2,252,549.

SUMMARY OF THE INVENTION

The present invention is broadly concerned with tool finishing machines of the type described in the incorporated by reference patent, but includes an improved tool supporting table and support mechanism therefor. Broadly speaking, the tool hereof includes a shiftable abrasive member presenting an abrasive, tool-engaging face, along with a generally planar, tool-supporting table located adjacent the face. The table is mounted for back-and-forth movement along the abrasive face by means of structure including a base located beneath the table and a shiftable element connected to the table for movement thereof in unison. The element and base are operably coupled together by means of at least three spaced apart roller bearings and complementary track structure receiving the bearings. The bearings are preloaded and resiliently urged into the associated track means, preferably through the use of an internal or structural spring. In particularly preferred forms, the bearings are coupled to the base, and the latter is relieved, such as by means of an elongated slot between bearings and dividing the base into opposed sections; one of the base sections is secured to an underlying upright plate by means of a screw received in an oversized bore provided in the base section. This permits limited lateral movement of the so connected base section relative to the adjacent section.

In further preferred forms, one of the roller bearings is connected to a base section by means of an eccentric mount, so that the effective distance between roller bearings can be varied. This mounting, in conjunction with the described relief in the base, permits the bearings to be preloaded relative to the track structure during manufacture of the machine, by placing the respective base sections in tension.

The table is supported for tilting movement by means of one, and preferably a pair, of upstanding support plates connected to the base and mounted for pivotal movement thereof through a predetermined arc. Friction lock means is provided for selectively locking the table at any one of a number of desired positions along the arc, to thereby vary the angle between the tool-supporting table and the abrasive face of the abrasive member. Preferably, a spring-loaded counterbalancing mechanism is operatively connected to the upright plates for urging the latter and the table upwardly. In this fashion, quick and precise settings of the table at any desired tilt angle are facilitated.

BRIEF DESCRIPTION OF THE DRAWINGS

FIG. 5 is an enlarged, fragmentary view in partial vertical section illustrating in detail the table-supporting structure of the machine;

FIG. 6 is a top view of the tool-supporting table forming a part of the machine, with successive sections thereof being broken away to illustrate the construction of the components lying beneath the table;

FIG. 7 is a sectional view taken along line 7—7 of FIG. 6;

FIG. 8 is a sectional view taken along line 8—8 of FIG. 6; and

FIG. 9 is a sectional view taken along line 9—9 of FIG. 5, with the operation of the friction lock mechanism being illustrated in phantom.

DESCRIPTION OF THE PREFERRED EMBODIMENT

Figure 1:
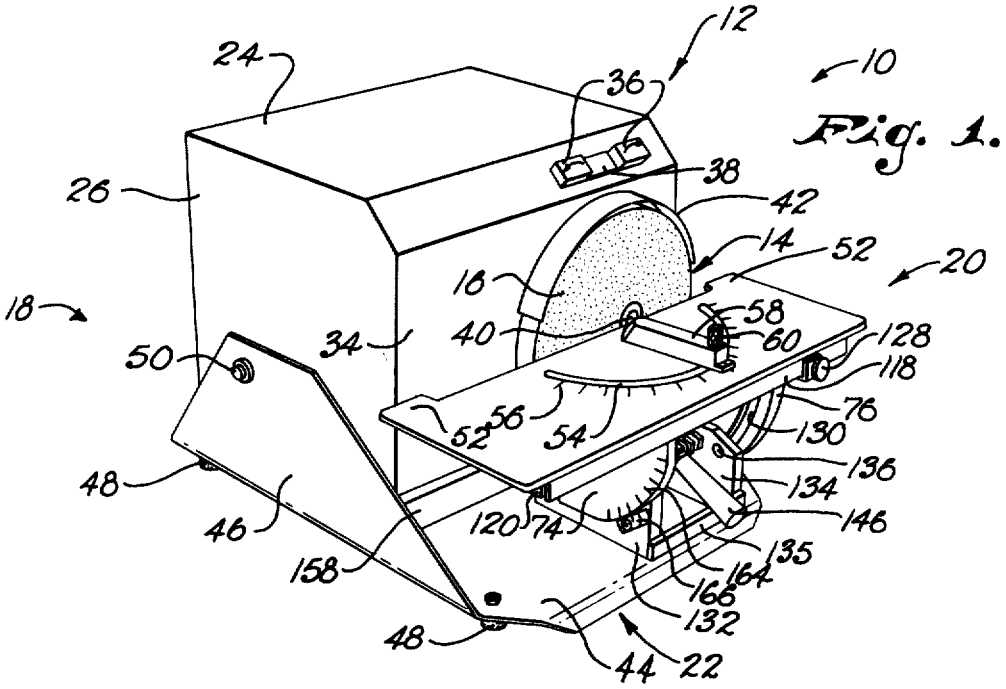
FIG. 1 is a perspective view of a tool finishing machine in accordance with the invention, shown with the abrasive wheel thereof in a generally upright orientation.
Figure 2:
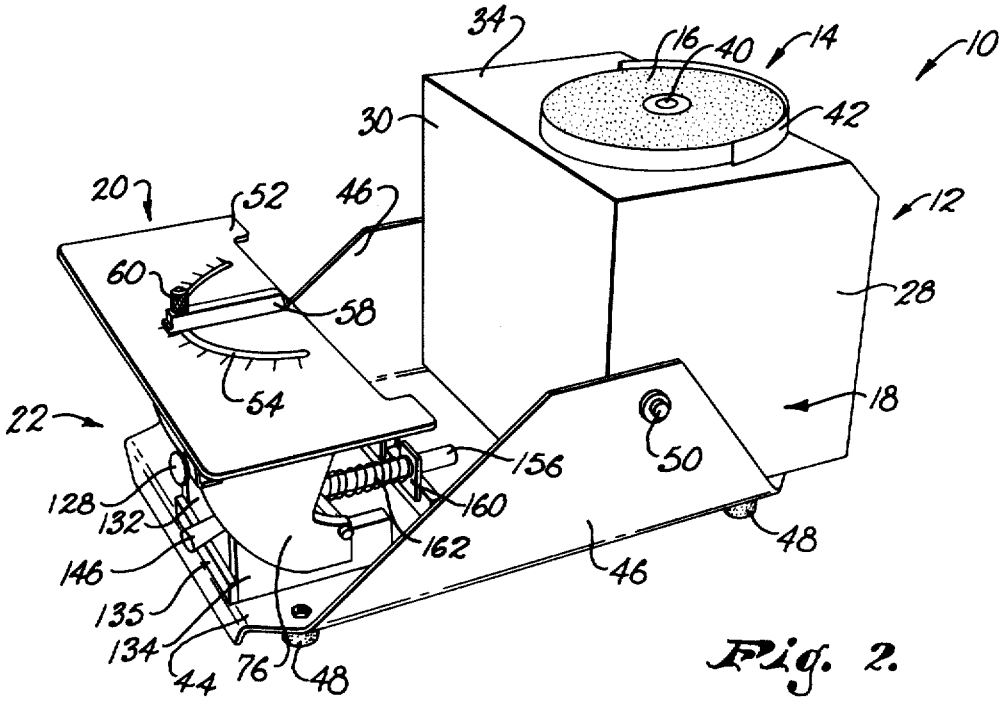
FIG. 2 is another perspective view of the machine, but illustrating the wheel in its generally horizontal position spaced from the tool-supporting table.
Figure 3:
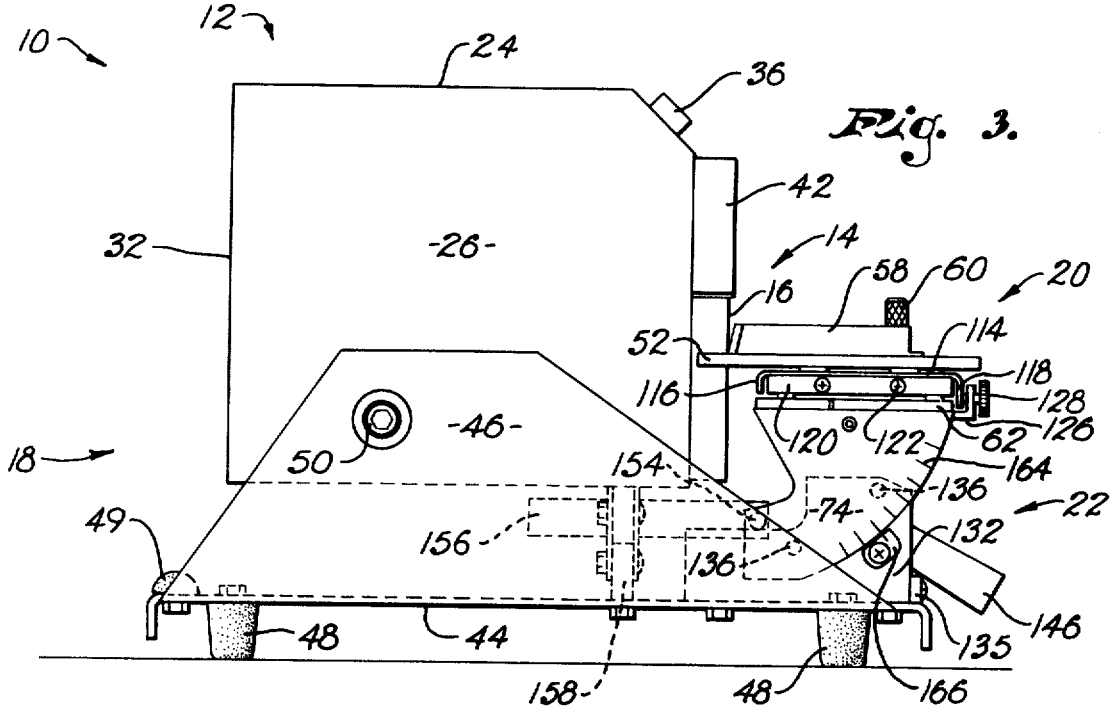
FIG. 3 is a side elevational view of the machine in the FIG. 1 position thereof, with certain of the table supporting structure schematically depicted in phantom.
Figure 4:
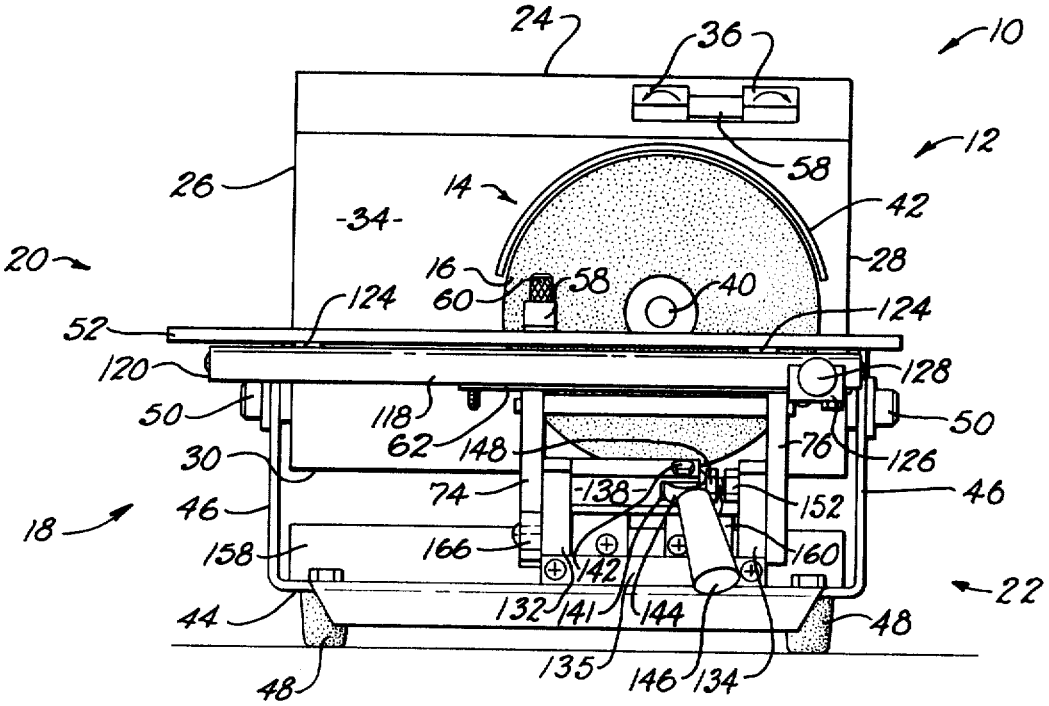
FIG. 4 is a front elevational view of the machine illustrated in FIG. 3.

Turning now to the drawings, a tool finishing or sharpening machine 10 is illustrated in FIGS. 1 and 2 in two operational configurations thereof. Broadly speaking, the machine 10 includes a main housing 12 having therewithin a conventional motor (not shown), an abrasive wheel 14 having an abrasive, generally planar face 16, means broadly referred to by the numeral 18 supporting the housing 12 and wheel 14 for pivotal movement thereof, a generally planar tool-supporting table 20, and structure referred to by the numeral 22 supporting table 20 for lateral back-and-forth movement thereof, as well as for selective tilting of the same.

In more detail, housing 12 is of metallic construction and includes a top wall 24, spaced apart sidewalls 26, 28, a bottom wall 30, a rear wall 32 and a front wall 34. A pair of motor activating "on" switches 36 are provided in front wall 34 for activating the internal motor and respectively rotating wheel 14 in opposite directions, along with a central "off" switch 38.

The wheel 14 is of known construction and is of circular configuration presenting the essentially planar abrasive face 16. Wheel 14 is mounted for rotation on a central shaft 40 coupled to the internal motor. In addition, an arcuate metal guard 42 is secured to and extends outwardly from front wall 34 in conforming relationship to the shape of wheel 14 as illustrated.

The support means 18 includes a metallic, somewhat U-shaped plate presenting a generally planar bottom wall 44, and a pair of upstanding, spaced apart side members 46. Four resilient feet 48 are secured to the underside of bottom wall 44 for the purpose of supporting the machine 10 on a work surface, whereas two housing-engaging feet 49 are secured to the near margin of wall 44 to support housing 12 in the FIG. 2 position thereof. The housing 12, and thereby the motor therewithin and abrasive wheel 14, are supported for pivotal movement between the side members 46 by means of appropriate pivotal connections 50. As best seen from a study of FIGS. 1 and 2, the housing 12 is pivotal between a position (see FIG. 1) wherein the face 16 of wheel 14 is in a generally upright orientation and is adjacent table 20, to a position (see FIG. 2) wherein the face 16 is generally horizontally oriented and is spaced from the table 20.

The tool-supporting table 20 is of essentially planar, metallic construction and presents a pair of innermost (i.e., closest to the housing 12) endmost ears or projections 52 which facilitate certain types of sharpening operations, along with an arcuate slot 54 therethrough and a series of graduations 56 along the slot 54. An elongated, bar-like tool guide 58 is supported on the upper surface of table 20, and is pivotally and removably mounted thereon by means of a pin extending through the guide and received into a complemental aperture in table 20 (not shown). The outermost end of the guide 58 is provided with a knurled, rotatable locking knob 60 operatively connected to conventional, releasable structure for selectively locking the guide 58 at any desired position along the length of slot 54.

The table-supporting structure 22 includes an elongated, planar, relieved base 62 of metallic construction. The base 62 (see FIG. 6) is provided with an elongated slot 64 therein which terminates in a communicating aperture 66. The base 62 is further relieved by means of a notch 68 extending inwardly from the innermost face of the base toward aperture 66. It will be appreciated in this regard that the slot 64 serves to divide the base 62 into a pair of juxtaposed sections 70, 72.

The base 62 is supported by means of a pair of spaced apart, stationary upright plates 74, 76. The plate 76 is secured to base 62 by means of a pair of conventional screws 78. In like manner, base section 72 is secured to the outermost end of plate 74 by means of a conventional screw 80. However, and referring specifically to FIGS. 6 and 7, it will be observed that the inner base section 70 is secured to the inner end of plate 74 by means of a specialized connector 82. Specifically, at the region of connector 82, the base section 70 is provided with an oversized bore 84. A fastener in the nature of a clamping screw 86 is inserted through the bore 84 as illustrated, with a washer 88 being interposed between the upper surface of base section 70 and the underside of the head of screw 86. During manufacture, screw 86 is threaded into bore 90 only to an extent that washer 88 lightly engages the upper surface of base section 70, without a tight friction fit therebetween. At this point, a set screw 92 is inserted into bore 90 from the open bottom thereof and threaded into the bore until it abuts the lowermost end of screw 86, thereby preventing further tightening or loosening of the screw 86. Accordingly, it will be perceived that the base section 70 is allowed a limited forward and backward "play" by virtue of the oversized bore 84 and slot 64, but that the base section 70 is held against substantial vertical movement. The importance of this construction will be made clear hereinafter.

A total of three spaced apart roller bearings are secured to the upper surface of base 62. The roller bearing assembly includes a pair of endmost, conventional bearings 94 respectively located at the ends of base 62 adjacent the forward or outer edge thereof (only one of the bearings 94 is depicted in FIG. 6), i.e., on outer base section 72. The third bearing 96 is located on inner base section 70 adjacent the inner edge of base 62 and between the outer bearings 94. The bearing 96 is mounted for eccentric movement thereof about an upright axis so as to permit variation of the effective distance between the inner bearing 96 and the outer bearings 94. In particular, and referrring to FIG. 8, it will be seen that the bearing 96 is mounted on an eccentric member including an integral spacer 98 having an upright, tubular, internally threaded, off center shaft 100 and a depending, centrally located, threaded stud 102 provided with an endmost kerf 104 therein. The bearing 96 is disposed about the upright shaft 100, and is held in place thereon by means of a screw 106 inserted into the shaft 100. A nut 108 is threaded onto the stud 102 as seen in FIG. 8, in order to hold the entire assembly, and thereby bearing 96, at any desired eccentric position.

The supporting structure 22 further includes an elongated shiftable element 110 of substantially rectangular configuration and provided with structure along the inner and outer edges thereof defining respective bearing-receiving tracks 112. As best seen in FIG. 5, the inboard track 112 receives the bearing 96, whereas the outboard track 112 receives the bearings 94.

A cover 114 is secured by screw means (not shown) to the upper surface of element 110 for shifting movement with the element. The cover 114 is substantially U-shaped in cross section, presenting an upper web adjacent the underside of table 20, as well as inboard and outboard depending lips 116, 118. In addition, separate end cover plates 120 are secured to the left and righthand end of element 110 by means of screws 122. The upper web of cover 114 is also secured to table 20 by means of spaced cap screw connectors 124. Accordingly, it will be appreciated that table 20 is operatively coupled to element 110, and that the element 110, cover 114, and table 20 shift laterally in unison. Finally, it will be observed that an L-shaped member 126 is secured to stationary base 62 and has a thumbscrew 128 supported thereon for engaging the outboard lip 118 of cover 114. The purpose of this structure will be made clear hereinafter.

The table-supporting structure 22 further includes means for tilting movement of the table 20 as desired.

Specifically, it will be seen that each upstanding plate 74, 76, is provided with an arcuate track 130 along the inner face thereof. A pair of upstanding, stationary mounts 132, 134 having a crossbrace 135 therebetween are secured to bottom wall 44 and are located between and respectively adjacent the plates 74, 76. Each mount 132, 134, includes a pair of outwardly extending dowels 136 which are received within a corresponding track 130 in the adjacent plate. Accordingly, it will be perceived that the plates 74, 76, and thereby the table 20, are shiftable through a predetermined arc defined by the tracks 130 and dowels 136.

A friction lock assembly is also provided for selectively locking the plates 74, 76 at any desired position along their arc of travel, so that the table 20 can be locked at a desired tilt angle relative to face 16. Specifically, and referring to FIGS. 5 and 9, it will be observed that an elongated, stationary bar 138 is fixedly secured to mount 132 by means of bolt 140. The end of bar 138 remote from mount 132 is bifurcated as at 141 and is provided with a transversely extending pin 142. An eccentric 144 having an off center bore therethrough is mounted on the pin 142 between the bifurcations of the bar 138 for rotation of the eccentric 144. An operating handle 146 is operatively coupled to the eccentric 144 and extends outwardly therefrom at a convenient angle. The mount 134 is provided with an adjustable, eccentric-engaging stop in the form of a bolt 148 extending into a threaded bore 150 provided in the wall of mount 134. A locking nut 152 is also threaded onto the bolt 148 as shown. As can be readily seen, the effective length of bolt 148 can be altered simply by threading the same inwardly or outwardly within bore 150.

Referring again to FIG. 5, it will be seen that an elongated, transversely extending shaft 154 is connected between the pivotal plates 74, 76. A rearwardly extending rod 156 is secured to the shaft 154 intermediate the ends thereof. The end of rod 156 remote from shaft 154 is supported by a crosspiece 158 secured to bottom wall 44, along with an upstanding, apertured plate 160 secured to crosspiece 158 and slidably receiving rod 156. A coil spring 162 is disposed about rod 156 and is captively retained between shaft 154 and plate 160. It will thus be seen that spring 162 serves to impart a biasing force against shaft 154, and thereby ultimately to table 20, serving to urge the latter upwardly in opposition to the force of gravity acting to pull the same to its lowermost position.

In the use of machine 10, the housing 12 can be pivoted to either the FIG. 1 or FIG. 2position thereof. In the FIG. 2 position, completely free and unobstructed use of wheel 14 can be obtained. On the other hand, when housing 12 is pivoted to the FIG. 1 position thereof, table 20 is adjacent the face 16 for tool-supporting purposes. In the latter connection, the roller bearing assembly hereinabove described permits smooth, easy back-and-forth movement of the table 20. The limits of such movement are defined by the respective cover plates 120, when the latter abut the endmost, outer roller bearings 94. Further, thumbscrew 128 can be employed to lock the table 20 at any desired lateral position thereof, inasmuch as the thumbscrew 128 bears against lip 118 of cover 114, the latter being connected to both element 110 and table 20 as described.

A very important feature of the present invention stems from the fact that, by virtue of the use of the slotted base 62 serving to divide the latter into effective sections 70, 72, along with specialized connector 82 and eccentrically mounted bearing 96, an effective internal or structural spring is presented. Specifically, during the manufacture of machine 10, the base 62 is secured to the plates 74, 76 in the manner outlined, i.e., such that a limited amount of forward and rearward "play" of the section 70 is permitted. The width of element 110 between the marginal tracks 112 is then measured, and the distance between the bearings 94 and 96 is set to a predetermined interference fit distance. In this operation the nut 108 is first loosened, and stud 102 rotated until the eccentric is properly positioned relative to the bearings 94, whereupon nut 108 is retightened. The element 110 is then forced between the bearings 94, 96 which serves to slightly spread the sections 70, 72 at the region of slot 64, such being permitted by virtue of oversize bore 84. This has the effect of loading sections 70, 72 in tension, whereas the bearings are correspondingly loaded in compression and resiliently urged into the respective tracks. Hence, a smooth, trouble free and constant back-and-forth shifting of element 110 (and hence table 20) is assured. It will also be appreciated that the described construction permits proper preloading of the bearings 94, 96, without the necessity for precision manufacture of all of the components. The use of the eccentrically mounted bearing, in conjunction with the slotted plate and specialized connector 82, make it possible to accommodate for tolerance and other manufacturing errors. Further, the bearing loading can be easily field adjusted as well to meet the desires of the end users.

When the user wishes to tilt table 20 relative to face 16, it is only necessary to rotate handle 146 to the position thereof illustrated in phantom in FIG. 9, until the eccentric 144 is out of pressing engagement with bolt 148. At this point the table can be manually pivoted downwardly (using the marginal scale 164 on plate 74 and indicator 166 on mount 132 for this purpose) until the desired position is reached, whereupon the handle 146 is again grasped and rotated until eccentric 144 firmly engages bolt 148. In such position, it will be seen that the respective mounts 132, 134, are pressed outwardly against the shiftable plates 74, 76, in order to frictionally hold the latter in the desired position. The frictional locking force between the mounts 132, 134 and the plates 74, 76, can be adjusted simply by rotating bolt 148 inwardly or outwardly as necessary.

During the downward shifting of table 20 as described, the spring 162 comes into play as a counterbalancing mechanism. Specifically, it has been found that the weight of the table and its supporting assembly are such that, absent counterbalancing, the table tends to drop rapidly under the influence of gravity, thereby making precise positioning thereof difficult. However, as explained, the spring 162 provides a counterbalancing force serving to urge table 20 upwardly, and this slows the descent of table 20 making accurate positioning thereof very easy.

We claim:

1. In a tool sharpening and finishing machine having a rotatable wheel provided with an abrasive, tool-engaging face and a tool-supporting table adjacent said face, structure supporting said table including:

an elongated element underlying said table;

means interconnecting the table and said element;

an elongated base underlying the element;

rollers on the base engaging the longitudinal edges of said element and supporting the latter for reciprocation along the base, said base having a longitudinal slot extending inwardly from one end thereof in the direction of reciprocation of said element, presenting a pair of elongated sections, there being a roller on each section respectively stationary means underlying the base; and means attaching the base to said stationary means and holding one of the sections against movement toward and away from the other section, the roller on said other section having means yieldably biasing the latter toward said one section.

2. The invention of claim 1, and means interconnecting the stationary means and said other section for holding the same against movement away from said one section.

3. The invention of claim 2, said interconnecting means including a bore in said other section and a fastener extending through the bore and into said stationary means for clamping said other section to the stationary means, the bore being larger than the fastener.

4. The invention of claim 1, said base having an aperture larger than the slot at the inner end of the latter for augmenting the resilient movement of said other section toward and away from said one section.

5. The invention of claim 1, said base having an aperture larger than the slot at the inner end of the latter and a notch in said other section at one longitudinal edge of the base in opposed relation to the aperture for augmenting the resilient movement of said other section toward and away from said one section.

6. The invention of claim 1, said element having roller-receiving tracks along said longitudinal edges thereof.

7. The invention of claim 1, said roller on said other section having eccentric means for varying the tension exerted thereby on said other section.

8. In a tool finishing machine including a rotatable, abrasive wheel presenting a substantially planar, tool-engaging face, means for shifting said wheel between a generally upright position and a generally horizontal position, and a substantially planar tool-supporting table disposed adjacent said wheel when the wheel is in the upright position thereof, improved structure for supporting said table comprising:

an upstanding plate beneath said table;

means coupling said plate to said table;

means supporting said plate for selective pivotal movement of the plate through a predetermined arc for changing the angle between the table and said tool-engaging face, when the wheel is in the upright position thereof;

friction lock means operatively coupled to said plate for selectively locking said plate at any one of a number of positions along said arc;

spring-loaded counterbalancing means operatively connected to said plate for urging said plate and table upwardly, said means coupling said plate to said table including:

a base member connected to said plate;

an element connected to said table; and a roller bearing assembly operatively coupling said base and upper members for permitting lateral, back-and-forth shifting of the upper member and table.

* * * * *